United States Patent [19]

McManus

[11] Patent Number: 4,836,427

[45] Date of Patent: Jun. 6, 1989

[54] TENNIS UTILITY BELT

[76] Inventor: Phillip W. McManus, 1701 Hardy Rd., Grand Prairie, Tex. 75051

[21] Appl. No.: 185,847

[22] Filed: Apr. 25, 1988

[51] Int. Cl.[4] ..... A45F 3/00

[52] U.S. Cl. ..... 224/224; 224/247; 224/919; 224/901

[58] Field of Search ..... 224/247, 919, 901, 224, 224/242, 191

[56] References Cited

U.S. PATENT DOCUMENTS

| | | | |
|---|---|---|---|
| 1,814,887 | 7/1931 | Bender . | |
| 2,508,190 | 5/1950 | Previdi . | |
| 2,926,912 | 3/1960 | Gould | 224/919 |
| 4,079,871 | 3/1978 | Sica | 224/919 |
| 4,119,247 | 10/1978 | Newquist et al. | 224/191 |
| 4,416,404 | 11/1983 | Daniels | 224/224 |
| 4,433,803 | 2/1984 | Liberboim | 224/919 |

FOREIGN PATENT DOCUMENTS

| | | | |
|---|---|---|---|
| 2813432 | 10/1979 | Fed. Rep. of Germany | 224/919 |
| 2491343 | 4/1982 | France | 224/191 |

*Primary Examiner*—Henry J. Recla
*Assistant Examiner*—Linda J. Sholl
*Attorney, Agent, or Firm*—Dennis T. Griggs

[57] ABSTRACT

A tennis ball holder belt having first and second end portions for securing the belt about the waist of a tennis player and the belt having a plurality of elastic tennis ball retainer cages attached thereto. Each elastic cage includes parallel elastic strips attached to upper and lower annular elastic bands and arranged generally in the form of an open cylinder. Alternatively, a series of elastic cages is constructed of elastic web segments secured to the belt at even intervals and reinforced at its upper and lower edges by narrow elastic strips. In either embodiment, a tennis ball is fitted through the upper or lower opening of the retainer cage, and the elastic bands stretch around the tennis ball to hold it securely during the play or practice of a tennis match. As desired, a tennis ball may be quickly and easily removed from the cage through either the upper or lower opening simply by applying light finger pressure to the exposed top or bottom portion of the ball.

3 Claims, 2 Drawing Sheets

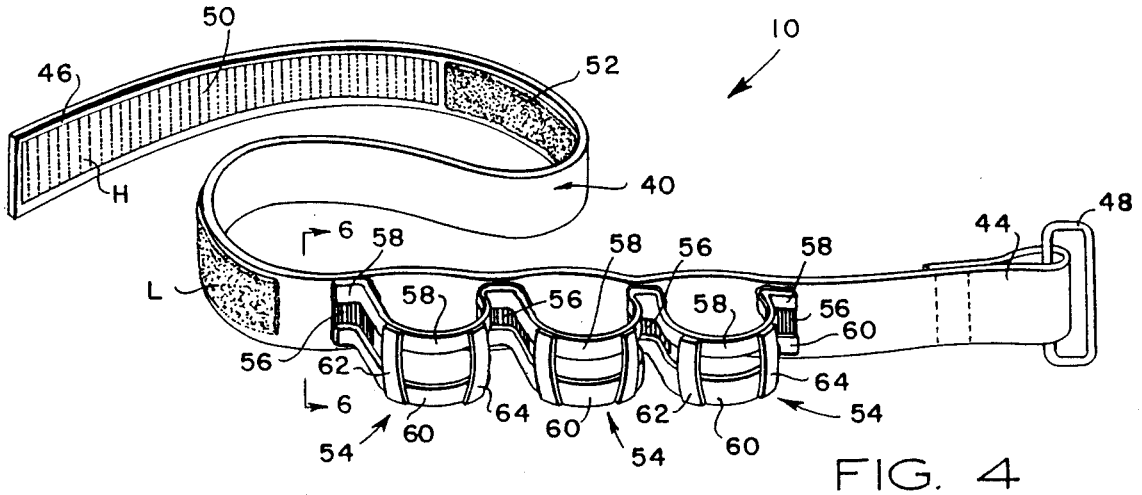
FIG. 4
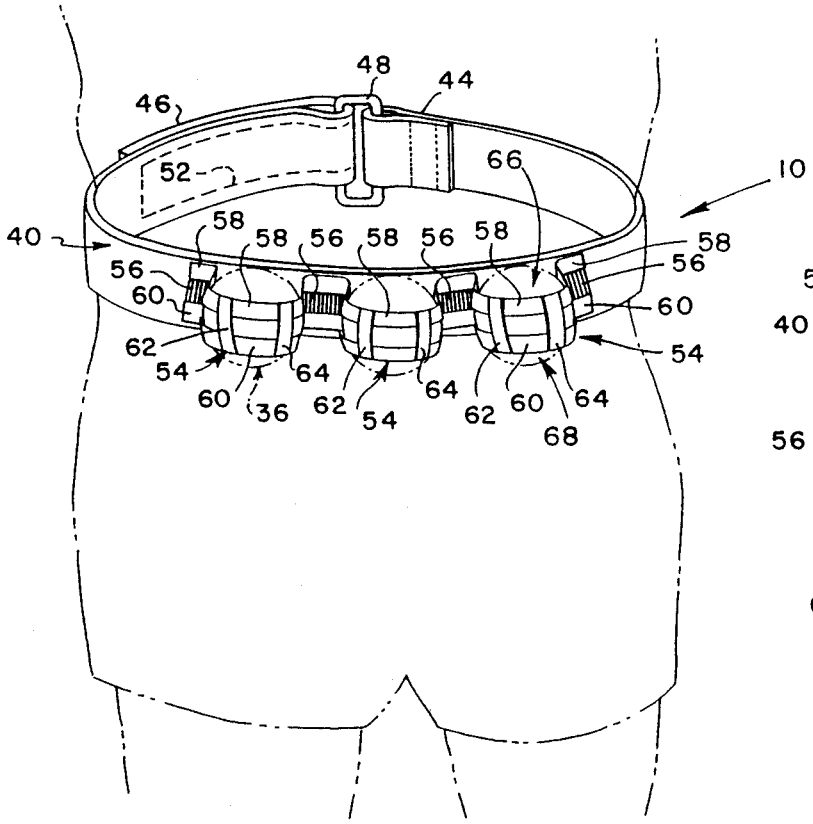
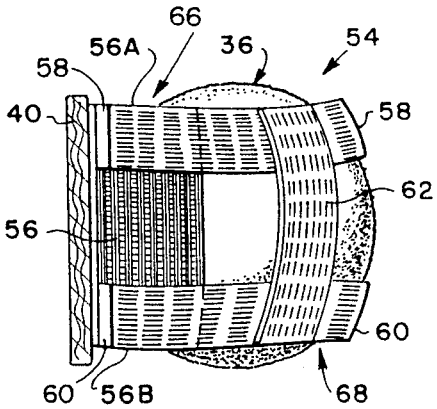
FIG. 6
FIG. 5

TENNIS UTILITY BELT

FIELD OF THE INVENTION

The present invention relates to a sports utility belt, and more particularly to a tennis ball holder belt for the purpose of securely holding a number of tennis balls during the practice or play of a tennis match.

BACKGROUND OF THE INVENTION

Play of a tennis match requires the use of only one tennis ball. However, it is often necessary that a player have ready access to additional tennis balls should the play ball be sent out of bounds or become otherwise unavailable. Practice of a tennis match likewise requires immediate access to a number of tennis balls in order that a player may effectively practice specific aspects of play, such as serving the tennis ball. During either play or practice, ready availability of a sufficient number of tennis balls is necessary if the game is to proceed without undesired delay.

DESCRIPTION OF THE PRIOR ART

The broad concept of providing a tennis ball holder belt is well known. U.S. Pat. No. 4,433,803 discloses a tennis ball holder belt having cloth pockets which are stitched and gathered, and which have an elastic strip formed about the pocket opening for retaining a ball within the pocket. An alternative version of the tennis ball holder belt of U.S. Pat. No. 4,433,803 includes a wide elastic strip which is fastened across a reticulated polymer surface. The tennis ball is secured in place beneath the elastic band when its fuzzy surface becomes entangled in the reticulated polymer material.

U.S. Pat. No. 4,079,871 discloses similar pocket arrangement in which textile fabric is pleated and gathered by an elastic strip for retaining a tennis ball within a longitudinally extending pocket.

Other tennis ball holder belt arrangements are shown in U.S. Pat. Nos. 2,508,190 and 1,814,887.

OBJECTS OF THE INVENTION

The principal object of the present invention is to provide a tennis ball holder belt having improved holders thereon for holding one or more tennis balls securely in place during play or practice of a tennis match.

A related object of the invention is to provide a tennis ball holder belt having improved means for securing the belt about the waist of a tennis player.

Another object of the invention is to provide a tennis ball belt havig lightweight construction which can be worn comfortably without interfering with the play of the game.

Yet another object of the invention is to provide an improved tennis ball holder belt to be worn while playing tennis which affords the player with immediate and convenient access to multiple tennis balls.

SUMMARY OF THE INVENTION

The present invention includes a tennis utility belt having improved means for securing the belt about the waist of a tennis player, and having one or more elastic cages thereon. In one embodiment, each cage is constructed of at least three parallel, elastic strips arranged generally in the form of a cylinder and stitched to upper and lower annular elastic bands. Two or more individual cages are attached to the tennis belt of the purpose of retaining two or more tennis balls during the play of a game of tennis.

In a second embodiment, each cage includes elastic web segments, with each web segment being reinforced at its upper and lower edges by a first pair of parallel elastic strips and stitched to the belt at even intervals. Each cage is stabilized by a second pair of parallel elastic strips which are secured across the first pair of elastic strips in bridging relation.

In both embodiments, a tennis ball is fitted through the upper or lower opening of the cage. The elastic bands stretch around the mid portion of the tennis ball to hold it securely during the play or practice of a tennis match. As desired, a tennis ball is quickly and easily removed from either the upper or lower opening of the cage simply by applying light finger pressure to the exposed top or bottom portion of the ball.

Other objects and advantages of the present invention will be appreciated by those skilled in the art upon reading the detailed description which follows with reference to the attached drawings.

BRIEF DESCRIPTION OF THE DRAWINGS

FIG. 4 is a front elevational view of a second preferred embodiment of the present invention;

FIG. 5 is a perspective view of the embodiment shown in FIG. 4, with tennis balls disposed in the elastic cage portions thereof; and, FIG. 6 is a side elevational view of a continuous elastic cage embodiment of the present invention, partly in section, taken generally along the line of 6-7 of FIG. 4.

DETAILED DESCRIPTION OF THE PREFERRED EMBODIMENT

Figure 1:
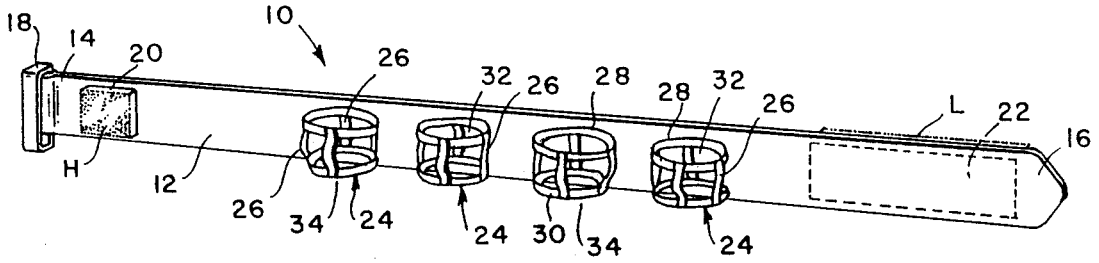
FIG. 1 is a front elevational view of a first preferred embodiment of the tennis utility belt of the present invention.

In the description which follows, like parts are indicated throughout the specification and drawings with the same reference numerals, respectively. The drawings are not necessarily to scale and the proportions of certain parts have been exaggerated to better illustrate details of the present invention.

Figure 2:
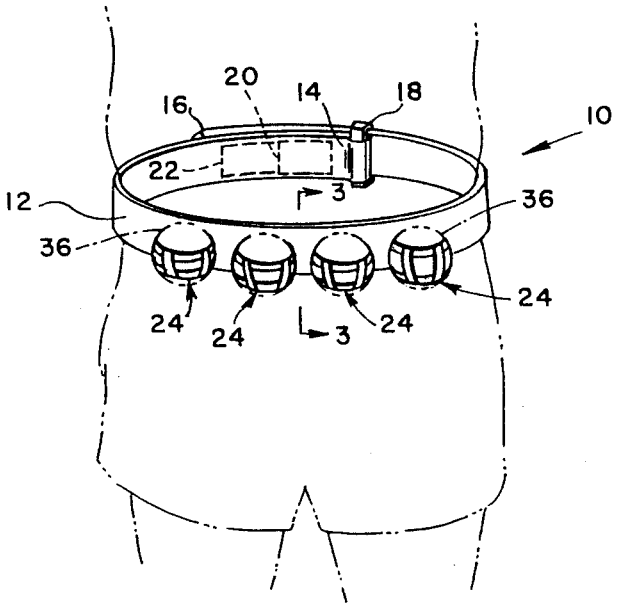
FIG. 2 is a perspective view of the embodiment of the invention shown in FIG. 1, with tennis balls disposed in the open cage portions thereof.

Referring to FIG. 1, a tennis utility belt is indicated generally by reference numeral 10. The belt 10 is constructed of an elongated strip 12 having two connectable ends 14 and 16 thereon. The first end 14 of belt 10 has a buckle retainer 18 through which end 16 is slideably engaged. Co-acting panel fasteners 20 and 22 are attached to ends 14, 16, respectively, to further secure belt 10 about the waist of a wearer, as shown in FIG. 2. Panel fasteners 20, 22 are preferably composed of interlockable hook (H) and loop (L) members generally known as Velcro ® fasteners.

The elongated strip 12 of belt 10 my be constructed of a variety of materials, including leather, cloth, canvas, plastic, and the like.

Figure 3:
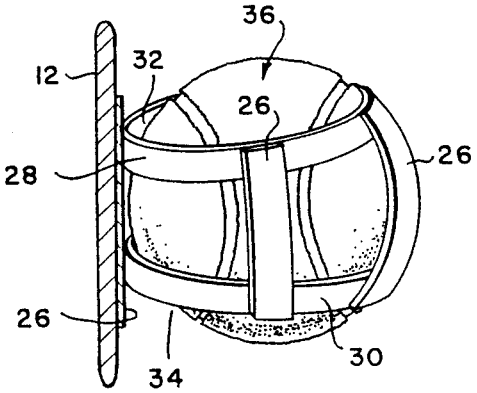
FIG. 3 is a side elevational view, partly in section, taken generally along the line 3—3 of FIG. 2.

As shown in FIGS. 1 and 2, stitched to elongated strip 12 is plurality of cage member 24. As more clearly shown in FIG. 3, each cage member 24 is constructed of four parallel, vertically oriented elastic strips 26 arranged generally in the form of a cylinder relaxed and unexpanded. The vertical strips 26 are stitched to annular elastic bands 28 and 30 which form upper and lower openings 32 and 34, respectively. A tennis ball 36 may be received through upper opening 32 or lower opening 34 and is securely held within cage member 24 by the expansion of the elastic strips 26 and elastic bands 28, 30 about its mid portion.

Each cage 24 is secured in place by stitching one of the elastic strips 26 onto the belt 12.

In FIG. 4, there is shown a second embodiment of the invention wherein belt 40 has two connectable ends 44 and 46 thereon. The first end 44 has a buckle 48 through which end 46 is slideably engaged. Panels 50, 52, preferably composed of Velcro ® Hook and loop fasteners H, L, are stitched in tandem relation onto end 46 of belt 40. After slideable engagement of end 46 through buckle 48, hook panel 50 is pressed onto loop panel 52 to secure belt 40 for a comfortable fit about the player's waist (FIG. 5).

Also shown in FIG. 4 is a plurality of cage members 54 attached to belt 40. In this embodiment, each cage member 54 is constructed of a plurality of elongated elastic web segments 56 stitched to belt 40 at evenly spaced intervals. As more clearly shown in FIG. 6, each elastic web segment 56 is reinforced about its upper and lower edges 56A, 56B by narrow elastic strips 58, 60 respectively.

Each cage 54 is reinforced by a pair of vertically oriented, parallel elastic strips 62, 64. The vertical elastic strips 62, 64 extend transversely across the horizontal elastic strips 58, 60 in bridging relation, and are stitched together.

Referring now to FIGS. 5 and 6, a tennis ball 36 is received through upper opening 66 or lower opening 68 and securely held within cage member 4 by the expansin of the elastic web segments 56, and elastic strips 58 and 60, and elastic strips 62, 64. As desired, a tennis ball may be removed from the cage through upper opening 66 or lower opening 68 simply by applying light finger pressure to the exposed top or bottom portion of ball 36.

Although the invention has been described with reference to specific embodiments, the foregoing description is not intended to be constructed in a limiting sense. Various modifications to the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A tennis ball holder belt comprising:

an elongated belt of flexible material having first and second end portions thereon;

a plurality of open elastic tennis ball retainer cages secured to the belt, said retainer cages being defined by transversely connected elastic strips; and, wherein each open elastic tennis ball retainer cage has first and second annular elastic bands defining upper and lower openings, respectively, and at least three elastic strips being connected intermediate the upper and lower annular bands, with the upper and lower annular bands and the intermediate elastic strips approximating the form of a cylinder when unexpanded, with at least one of the upper and lower annular bands being expandable to permit a tennis ball to be inserted into the cage through the upper or lower opening.

2. A tennis ball holder belt comprising, in combination:

an elongated belt of flexible material having first and second end portions thereon;

a plurality of open elastic tennis ball retainer cages secured to the belt, said retainer cage being defined by transversely connected elastic strips; and, wherein each elastic tennis ball retainer cage includes first and second web segments reinforced along upper and lower edges by first and second elastic strips, with said web segments being linked together by said first and second elastic strips, and including third and fourth elastic strips secured transversely across the first and second elastic strips in bridging relation therewith.

3. A tennis ball holder belt as defined in claim 2, wherein said web segments comprise an elastic material.

* * * * *

UNITED STATES PATENT AND TRADEMARK OFFICE

CERTIFICATE OF CORRECTION

PATENT NO. : 4,836,427

DATED : 06/06/89

INVENTOR(S) : Phillip W. McManus

It is certified that error appears in the above-identified patent and that said Letters Patent is hereby corrected as shown below:

Column 1, line 36, "discloses similar" should be -- discloses a similar --.

Column 1, line 52, "havig" should be -- having --.

Column 1, line 68, "of" should be -- for --.

Column 2, line 31, "." should be -- ; --.

Column 2, line 39, "6-7" should be -- 6-6 --.

Column 2, line 65, "is plurality" should be -- is a plurality --.

Column 2, line 65, "member" should be -- members --.

Column 3, line 35, "4" should be -- 54 --.

Column 3, line 35, "expansin" should be -- expansion --.

Signed and Sealed this

Thirtieth Day of January, 1990

*Attest:*

JEFFREY M. SAMUELS

*Attesting Officer*

*Acting Commissioner of Patents and Trademarks*